US005291778A

United States Patent [19]

Dexheimer et al.

[11] Patent Number: 5,291,778

[45] Date of Patent: Mar. 8, 1994

[54] HUNTING WIND DIRECTION INDICATOR

[76] Inventors: Thomas H. Dexheimer, R.R. 1, Box 182, Woodbourne, N.Y. 12788; John R. Nielsen, R.R. 1, Box 84B, Hurleyville, N.Y. 12747

[21] Appl. No.: 756,514

[22] Filed: Sep. 9, 1991

[51] Int. Cl.[5] ..... A63B 53/00

[52] U.S. Cl. ..... 73/170.05; 43/1

[58] Field of Search ..... 73/188, 170.05, 170.04; 43/1; 116/22 A, 214, 224; 242/85.1, 147 R, 157 R

[56] References Cited

U.S. PATENT DOCUMENTS

| | | | |
|---|---|---|---|
| 736,051 | 8/1903 | Adams | 124/88 |
| 2,938,514 | 5/1960 | Berg | 124/88 |
| 3,112,645 | 12/1963 | Glass | 73/188 |
| 3,395,577 | 8/1968 | Keim | 73/188 |
| 3,789,793 | 2/1974 | Keim | 73/188 |
| 3,815,412 | 6/1974 | Keim | 73/18 |
| 4,080,925 | 3/1978 | Moore | 73/188 |
| 4,302,899 | 12/1981 | Dehart | 43/1 |
| 4,378,781 | 4/1985 | Shiflett | 124/88 |
| 4,423,626 | 1/1984 | Herschede | 43/1 |
| 4,735,010 | 4/1988 | Grinarml | 43/1 |
| 4,788,787 | 12/1988 | Konietzki | 43/1 |
| 5,029,408 | 7/1991 | Smith | 43/1 |
| 5,143,044 | 9/1992 | Bourquin | 124/86 |

*Primary Examiner*—Richard E. Chilcot, Jr.
*Assistant Examiner*—Elizabeth L. Dougherty
*Attorney, Agent, or Firm*—Leon Gilden

[57] ABSTRACT

An indicator member is arranged for mounting to a barrel portion of a hunting rifle or to an interior surface of a hunting archery bow to include a boss mounting a filament, wherein the filament indicates wind orientation preventing hunter positioning to be exposed by downwind orientation of game. A hollow supporting boss is arranged to secure the filament and may be further provided with an interior spool to permit projection of the filament therefrom from a magazine support roll.

2 Claims, 3 Drawing Sheets

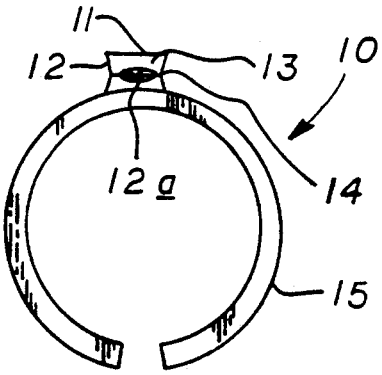
Fig 1
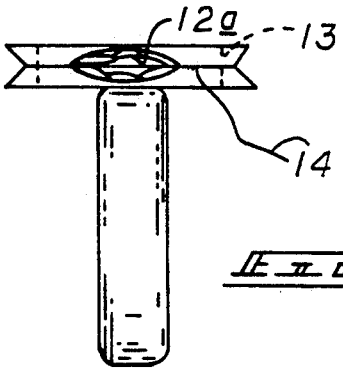
Fig 2
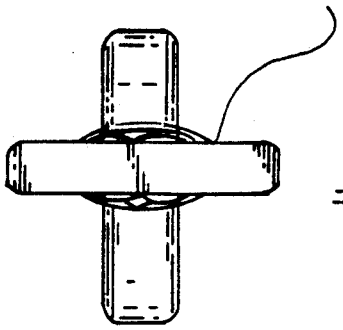
Fig 3
Fig 4
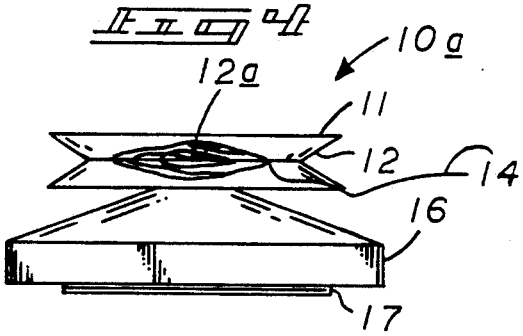
Fig 5
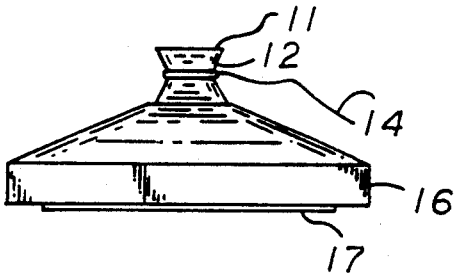
Fig 6
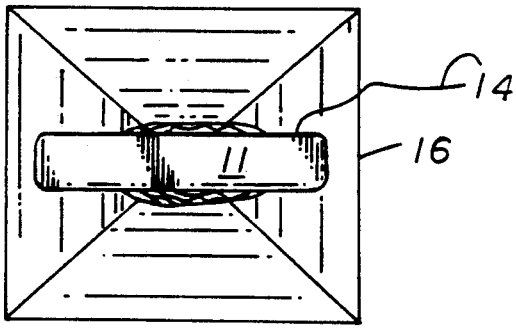

HUNTING WIND DIRECTION INDICATOR

BACKGROUND OF THE INVENTION

1. Field of the Invention

The field of invention relates to hunting wind indicators, and more particularly pertains to a new and improved hunting wind directional indicator wherein the same is mounted to a barrel portion of a rifle or archery bow for indicating wind orientation to prevent hunter location to a game animal.

2. Description of the Prior Art

The use of wind indicating structure is highly desirable in hunting situations, wherein game that may ascertain hunter position are alerted and will accordingly prevent a successful hunting situation. Wind indicator structure in the prior art has been utilized and exemplified in U.S. Pat. No. 4,646,567 to Ahmer wherein a sailboat member mounts a wind indicator structure, wherein a wind vane mounted upon a shaft is mechanically coupled with a pointer member positioned upon a dial.

U.S. Pat. No. 3,641,815 to Fassett utilizes a wind indicator structure utilizing a vane to properly orient an indicator pointer as to wind orientation.

U.S. Pat. No. 4,423,626 to Herschede sets forth a method of determining wind direction for hunters, wherein material such as unscented talc powder may be mixed with a masking scented material sprayed into the air permitting subsequent observation of the powder cloud.

Accordingly, it may be appreciated that there continues to be a need for a new and improved hunting wind direction indicator as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of wind direction indicator apparatus now present in the prior art, the present invention provides a hunting wind direction indicator wherein the same is arranged with a filament supported by a boss mounted to a hunting weapon to provide visual observation of wind direction. As such, the general purpose of the present invention, which will be described subsequently in greater detail, is to provide a new and improved hunting wind direction indicator which has all the advantages of the prior art wind indicator apparatus and none of the disadvantages.

To attain this, the present invention provides an indicator member arranged for mounting to a barrel portion of a hunting rifle or to an interior surface of a hunting archery bow to include a boss mounting a filament, wherein the filament indicates wind orientation preventing hunter positioning to be exposed by downwind orientation of game. A hollow supporting boss is arranged to secure the filament and may be further provided with an interior spool to permit projection of the filament therefrom from a magazine support roll.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved hunting wind direction indicator which has all the advantages of the prior art wind indicator apparatus and none of the disadvantages.

It is another object of the present invention to provide a new and improved hunting wind direction indicator which may be easily and efficiently manufactured and marketed.

It is a further object of the present invention to provide a new and improved hunting wind direction indicator which is of a durable and reliable construction.

An even further object of the present invention is to provide a new and improved hunting wind direction indicator which is susceptible of a low cost of manufacture with regard to both materials and labor, and which accordingly is then susceptible of low prices of sale to the consuming public, thereby making such hunting wind direction indicators economically available to the buying public.

Still yet another object of the present invention is to provide a new and improved hunting wind direction indicator which provides in the apparatus and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an orthographic frontal view of the instant invention.

FIG. 2 is an orthographic side view of the instant invention.

FIG. 3 is an orthographic top view of the instant invention.

FIG. 4 is an orthographic side view of an aspect of the invention for securement to an archery bow.

FIG. 5 is an orthographic side view of the invention, as set forth in FIG. 4.

FIG. 6 is an orthographic top view of the invention, as set forth in FIGS. 4 and 5.

FIG. 10 is an enlarged isometric illustration of the modified invention as set forth in FIG. 9.

DESCRIPTION OF THE PREFERRED EMBODIMENT

Figure 7:
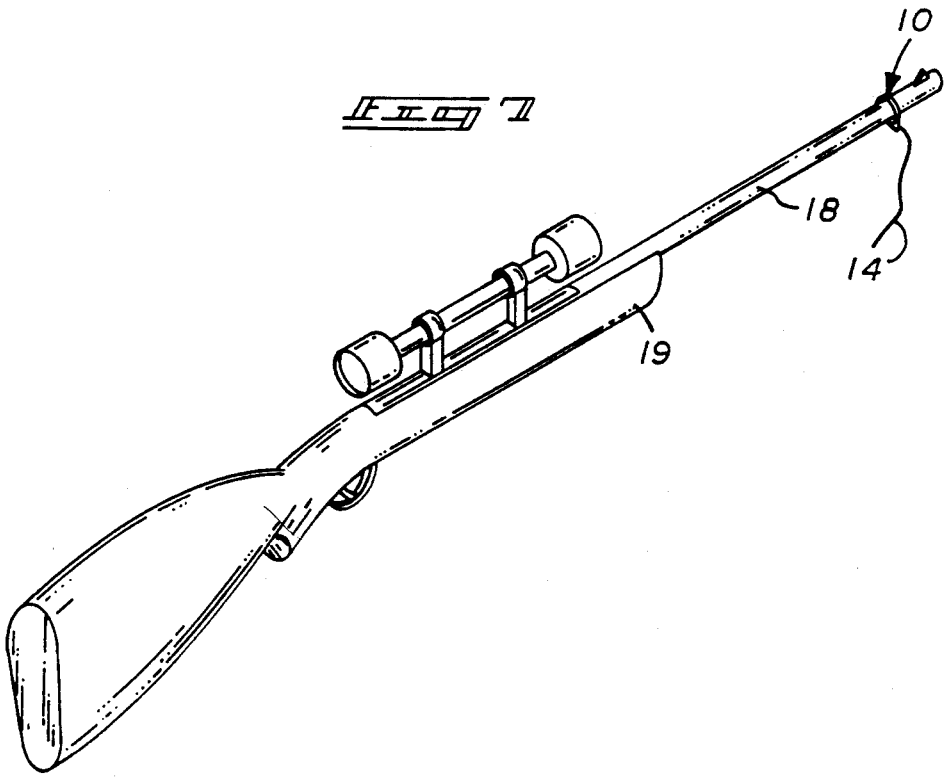
FIG. 7 is an isometric illustration of a hunting rifle utilizing the invention.
Figure 8:
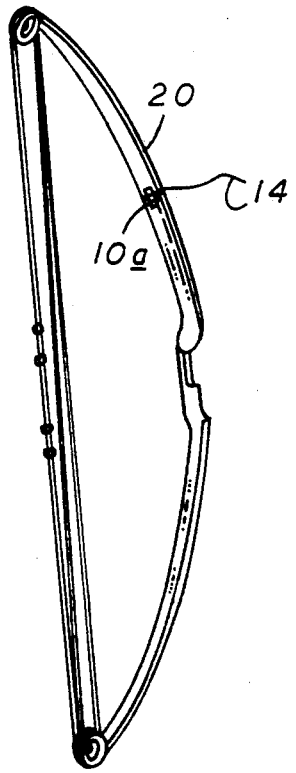
FIG. 8 is an isometric illustration of an archery bow utilized in the invention.

With reference now to the drawings, and in particular to FIGS. 1 to 10 thereof, a new and improved hunting wind direction indicator embodying the principles and concepts of the present invention and generally designated by the reference numeral 10 will be described.

More specifically, the hunting wind direction indicator 10 of the instant invention essentially comprises a hollow support spindle boss 11, including concave side walls 12. The spindle boss includes an interior cavity, with an exit opening 12*a* mounting a spool of thread filaments 13 therewithin, with an exterior quantity of filament wound about the concave side wall 12. A thread filament forward distal end 14 is arranged in a spaced relationship relative to the boss 11, whereupon prevailing wind will orient the forward distal end 14 for indication of wind direction. A support mount is defined by a split resilient clamp ring 15 for securement about a gun barrel 18 in a manner as illustrated in the FIG. 7. Alternatively, an indicator organization 10*a*, as illustrated in the FIGS. 4–6, includes a support base 16, with an adhesive bottom surface 17 for adhering the base 16 to an interior surface of an associated archery bow 20.

Figures 9, 11:
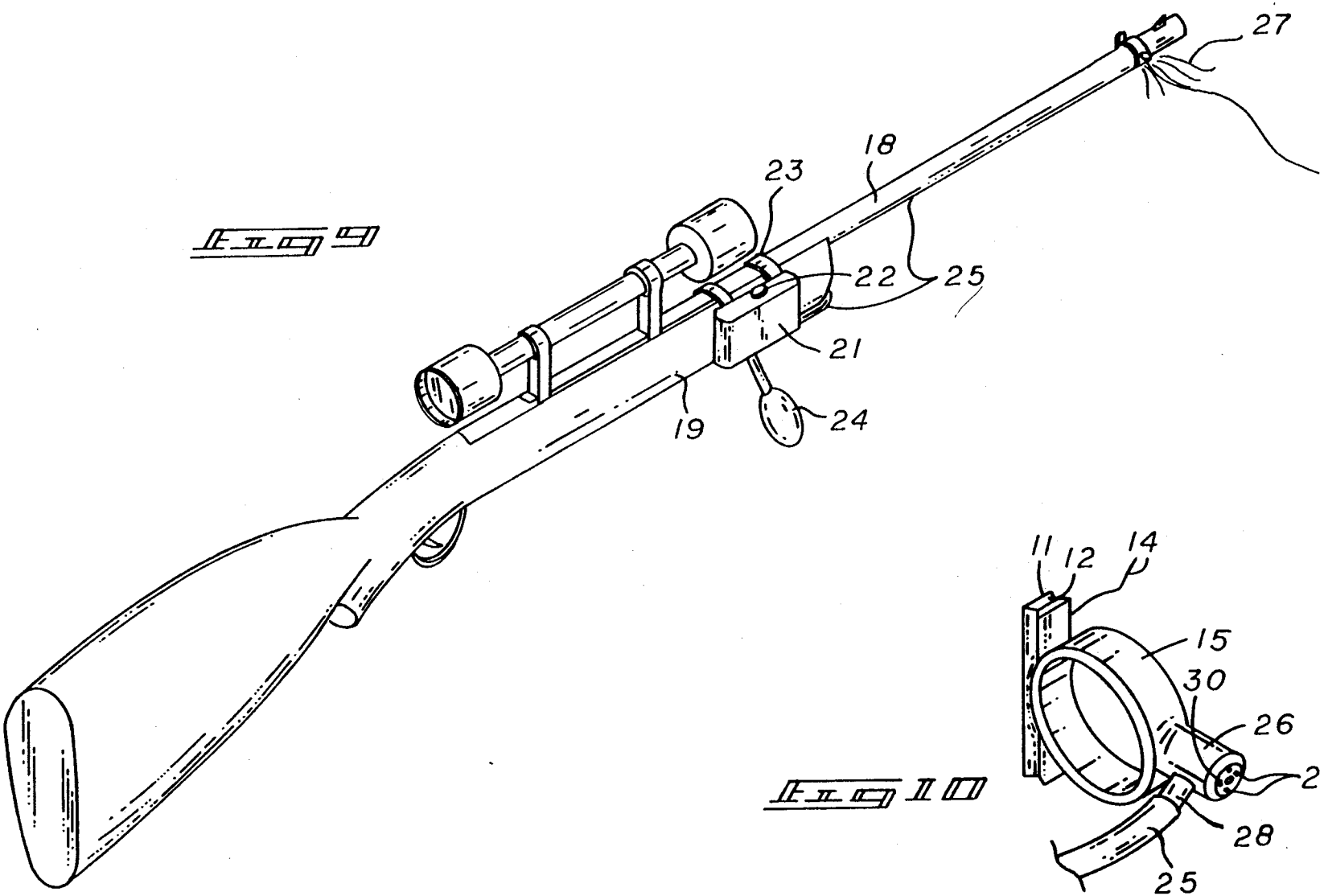
FIG. 9 is an isometric illustration of a modification of the invention.

A modified aspect of the invention, as illustrated in the FIGS. 9 and 10, defines a fluid reservoir 21, including a game attracting scented fluid 27, with a fill cap 22 including a plurality of securement members to include a securement strap 23 for securement of the reservoir 21 to the gun stock 19. A squeeze bulb 24 in operative pneumatic association with the reservoir 21 pressurizes the fluid therewithin and directs the fluid through a flexible feed conduit 25 that is mounted contiguously to the stock 19 along the gun barrel 18 and in pneumatic communication with a hollow dispensing boss 26 mounted to the ring 15. The dispensing boss includes a dispensing boss rigid feed conduit 28 for securement of the flexible feed conduit 25 thereto, with the dispensing boss including a dispensing boss end wall 30 including a matrix of dispensing boss apertures 29 to effect dispersion and projection of the game attracting scented fluid 27 therethrough. In this manner, should wind direction or prevailing wind suddenly change, a hunter may project the fluid to mask the hunter's presence in a hunting situation.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A hunting wind direction indicator for securement to a hunting weapon, wherein the apparatus includes a support spindle boss, the support spindle boss including a concave side wall, with the side wall mounting an elongate thread filament, with the thread filament including a filament forward distal end spaced from the support spindle boss, and the support spindle boss fixedly and coaxially mounted to a support member, the support member fixedly secured to the hunting weapon, and the spindle boss is hollow and includes a cavity having filament therewithin, and the concave side wall includes an exit opening, with the filament directed therethrough, and the filament oriented exteriorly of the cavity is wound about the convex side wall for securement of the filament, with the forward distal end spaced from the convex side wall in use, and the weapon includes a gun stock and a gun barrel, and the apparatus further includes a fluid reservoir secured to the gun stock, and mounting means for fixedly securing the fluid reservoir to the gun stock, and the reservoir including a squeeze bulb in pneumatic communication with the reservoir to pressurize the reservoir, and a game attracting scented fluid contained within the reservoir and directed through a flexible feed conduit upon depression of the squeeze bulb, and the flexible feed conduit including a flexible feed conduit forward terminal end, and a hollow dispensing boss mounted to the support member spaced diametrically relative to the spindle boss, and the hollow dispensing boss including a rigid conduit mounting the flexible feed conduit thereabout, and the hollow dispensing boss including an end wall, the end wall including a matrix of apertures directed therethrough for dispersion of the fluid directed through the flexible feed conduit into the hollow dispensing boss.

2. An apparatus as set forth in claim 1 wherein the support spindle boss is defined about support spindle boss axis, and the support member defined about a support member axis, wherein the support spindle boss axis is orthogonally oriented relative to the support member axis.

* * * * *